US010208415B2

(12) United States Patent
Reuben

(10) Patent No.: US 10,208,415 B2
(45) Date of Patent: Feb. 19, 2019

(54) METHOD OF AUTOMATICALLY FABRICATING PATTERN COMPOSITE FABRIC PIECES WITH SEAM ALLOWANCE FLAPS

(71) Applicant: Ronie Reuben, Town of Mount Royal (CA)

(72) Inventor: Ronie Reuben, Town of Mount Royal (CA)

(73) Assignee: Ronie Reuben, Town of Mount Royal, QC (CA)

( * ) Notice: Subject to any disclaimer, the term of this patent is extended or adjusted under 35 U.S.C. 154(b) by 414 days.

(21) Appl. No.: 14/998,509

(22) Filed: Jan. 15, 2016

(65) Prior Publication Data

US 2017/0204548 A1 Jul. 20, 2017

(51) Int. Cl.

| | |
|---|---|
| ***D05B 37/04*** | (2006.01) |
| ***D05B 27/00*** | (2006.01) |
| ***D05B 19/00*** | (2006.01) |

(52) U.S. Cl.

CPC ..... *D05B 37/04* (2013.01); *D05B 19/00* (2013.01); *D05B 27/00* (2013.01)

(58) Field of Classification Search

CPC ..... A41H 42/00; A41H 9/00; D05B 37/04

USPC ..... 700/130–133

See application file for complete search history.

(56) References Cited

U.S. PATENT DOCUMENTS

| | | | | |
|---|---|---|---|---|
| 2,164,499 | A * | 7/1939 | Coughlin | D03D 11/00 2/243.1 |
| 4,502,153 | A * | 3/1985 | Lapedes | A41D 27/02 2/81 |
| 4,739,910 | A * | 4/1988 | Westphal | A61F 13/15585 223/37 |
| 5,150,476 | A * | 9/1992 | Statham | A41D 31/0027 2/272 |
| 5,460,686 | A * | 10/1995 | Chung | A41D 27/245 156/510 |
| 5,935,882 | A * | 8/1999 | Fujita | A41D 19/01529 2/161.6 |
| 6,098,557 | A * | 8/2000 | Couillard | A41H 42/00 112/475.06 |
| 6,371,977 | B1 * | 4/2002 | Bumbarger | A41D 31/0027 2/102 |
| 7,560,399 | B2 * | 7/2009 | Rock | A41D 3/005 442/76 |
| 2002/0002938 | A1 * | 1/2002 | Alberts | A41H 42/00 112/475.06 |

(Continued)

*Primary Examiner* — Nathan Durham

(74) *Attorney, Agent, or Firm* — Guy J. Houle; Houle Patent Agency Inc.

(57) ABSTRACT

A method of fabricating pattern composite fabric pieces by an automatic pattern fabric article piece processing machine is described. A composite fabric sheet is fed in the processing machine onto a conveyor having a permeable belt under which is provided a vacuum chamber to retain the fabric sheet stationary while a laser cutter effects a programmed job function. The machine forms seam allowance flaps for the composite fabric pattern piece. A stitching or ultrasonic bonding machine also forms seams. In a further stage, printed matter may be applied to the allowance flaps. Glue may also be applied to the flaps and labels to some of the pattern fabric pieces. By interconnecting the seam allowance flaps of different fabric pieces, in a specific order, a fabric material article is produced.

14 Claims, 5 Drawing Sheets

(56) References Cited

U.S. PATENT DOCUMENTS

| | | | | |
|---|---|---|---|---|
| 2002/0005153 | A1* | 1/2002 | Ribble | A41B 9/06 112/475.08 |
| 2002/0005154 | A1* | 1/2002 | Ribble | A41H 42/00 112/475.08 |
| 2002/0005155 | A1* | 1/2002 | Nelson | A41H 42/00 112/475.08 |
| 2002/0006855 | A1* | 1/2002 | Alberts | A41H 42/00 493/442 |
| 2005/0145150 | A1* | 7/2005 | Mortell | A41B 9/001 112/475.09 |
| 2010/0269241 | A1* | 10/2010 | Baychar | A41D 31/02 2/69 |
| 2011/0035949 | A1* | 2/2011 | Fesler | B26B 13/22 30/233 |
| 2013/0144424 | A1* | 6/2013 | Jarbouai | G06F 9/06 700/134 |
| 2014/0215697 | A1* | 8/2014 | Lewis | A41D 31/0038 2/458 |
| 2014/0277683 | A1* | 9/2014 | Gupta | G06F 17/50 700/132 |

* cited by examiner

FIG. 14A
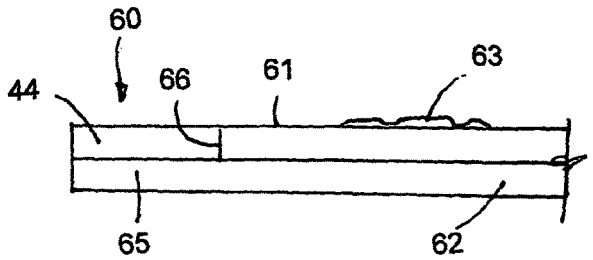
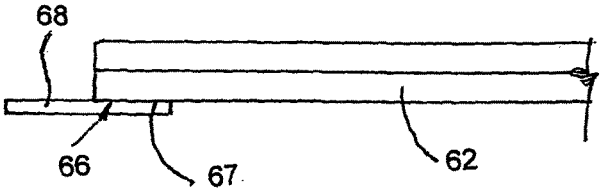
FIG. 14B
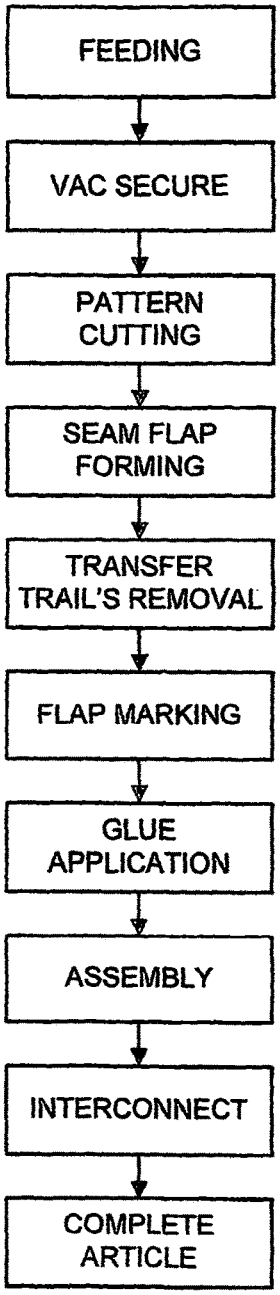
FIG. 15

METHOD OF AUTOMATICALLY FABRICATING PATTERN COMPOSITE FABRIC PIECES WITH SEAM ALLOWANCE FLAPS

TECHNICAL FIELD

The present invention relates to a method of automatically fabricating pattern composite fabric pieces with seam allowance flaps for interconnecting the fabric pieces together to form, for example, articles of apparel.

BACKGROUND OF INVENTION

The fabrication of articles formed of fabric pieces, such as articles of apparel, is very labour intensive and results in excessive material loss. It is also a slow manufacturing process and hence the reason why most of such articles are fabricated in countries where the labour is plentiful and the cost thereof is very low. Articles formed from fabric also requires stitching to interconnect fabric piece material together. This process becomes even more labour intensive when the articles are fabricated from composite material pieces wherein thermal insulation, in a solid or loose form, is sandwiched between opposed fabric material layers. If the fabric pieces require design features, such as embroidery, printing, patchwork, etc., this further adds to the cost.

The fabrication of such articles generally requires large factories with a great volume of stitching machines and assembly lines where semi-finished articles are passed on from person to person to arrive at a finish product. This often results in errors in the fabrication of fabric articles and waste. Any imperfect articles that find themselves on the marketplace results in poor quality goods and damage to the reputation of the product mark and its manufacturer. To substantially reduce these errors would require extensive on site inspection and further adding to the cost of producing the goods.

In view of the above, there is a need to fabricate articles of fabric at a reduced cost and in a non-polluting environment and with reduced labour content. Also, material waste should be reduced to the maximum and the articles of fabric should be assembled with precision and substantially free of errors in its assembly to produce a quality product.

SUMMARY OF THE INVENTION

It is a feature of the present invention to provide a method of fabricating pattern composite fabric pieces which substantially overcomes the above mentioned disadvantages and produces the above mentioned need.

It is a further feature of the present invention to provide an automatic processing machine to produce composite pattern fabric pieces and wherein the fabric pieces are easy to assemble in reduced time.

Another feature of the present invention is to provide such a process in a clean and non-polluting environment.

A further feature of the present invention is to provide an automatic machine for the fabrication of fabric articles and wherein the articles are of uniform quality due to precision manufacturing.

Another feature of the present invention is to provide a less labor intensive and faster and more efficient method of manufacturing pattern articles of fabric with interconnecting seam allowance flaps.

Another feature of the present invention is to provide a method of fabricating pattern composite fabric pieces incorporating therein embroidery patterns, and printing information and designs all combined in a single machine and process and performed automatically from a computer containing the fabrication information for the pattern composite fabric pieces.

A still further feature of the present invention is to provide a composite insulating material pattern piece wherein the insulation is held captive between opposed fabric layers and fabricated in accordance with the method of the present invention and wherein any waste insulation material, such as down or other insulation material may be recycled.

According to the above features, from a broad aspect, the present invention provides a method of fabricating pattern composite fabric pieces which comprises the steps of feeding a composite fabric sheet having two or more overlaid fabric sheets in an automatic pattern processing machine. The processing machine performs, in one or more specific order, the steps of laser or thermal cutting one or more pattern pieces from the composite fabric sheet, and forming one or more seam allowance flaps in outer edge portions of the pattern pieces.

According to another broad aspect, an in a stage of the machine, the pattern pieces and trailing sheet parts are separated and the pattern pieces are gathered. The pattern pieces are assembled and interconnected by their seam allowance flaps in a predetermined order to form a complete fabric article.

According to a further broad aspect of the present invention there is provided an automatically fabricated composite material pattern piece having an outer and inner fabric sheet secured together along a pattern seam line by fastening means. Seam allowance flaps are formed adjacent the pattern seam line and project from under outer edge portions of the outer fabric sheet to provide for attachment of the composite material pattern pieces in a specific order to form an insulating finished fabric article.

According to a still further broad aspect of the invention, there is provided a method of fabricating pattern composite fabric pieces and which comprises the steps of feeding a composite fabric sheet having at least an outer and an inner fabric sheet, in an automatic pattern fabric article piece processing machine. The processing machine performs, in one or more specific order the steps of (i) cutting one or more pattern pieces from the composite fabric sheet, and (ii) forming one or more seam allowance flaps in outer edge portions of the pattern pieces.

DESCRIPTION OF THE DRAWINGS

A preferred embodiment of the present invention will now be described with reference to the accompanying drawings wherein:

FIGS. 14A and 14B are fragmented side views showing two fabric sheets to be interconnected together to form a pattern article for interconnection with other pattern fabric articles and further illustrating two methods of forming the seam allowance flaps, one by cutting an outer one of the fabric sheets and the other by bonding a seam allowance strip along an edge portion of the outer surface of the inner fabric sheet; and FIG. 15 is a simplified flow block diagram illustrating a sequence of steps performed by the method of fabricating a complete fabric article including the pattern composite fabric pieces formed in accordance with the present invention.

DESCRIPTION OF THE PREFERRED EMBODIMENT

Figure 1:
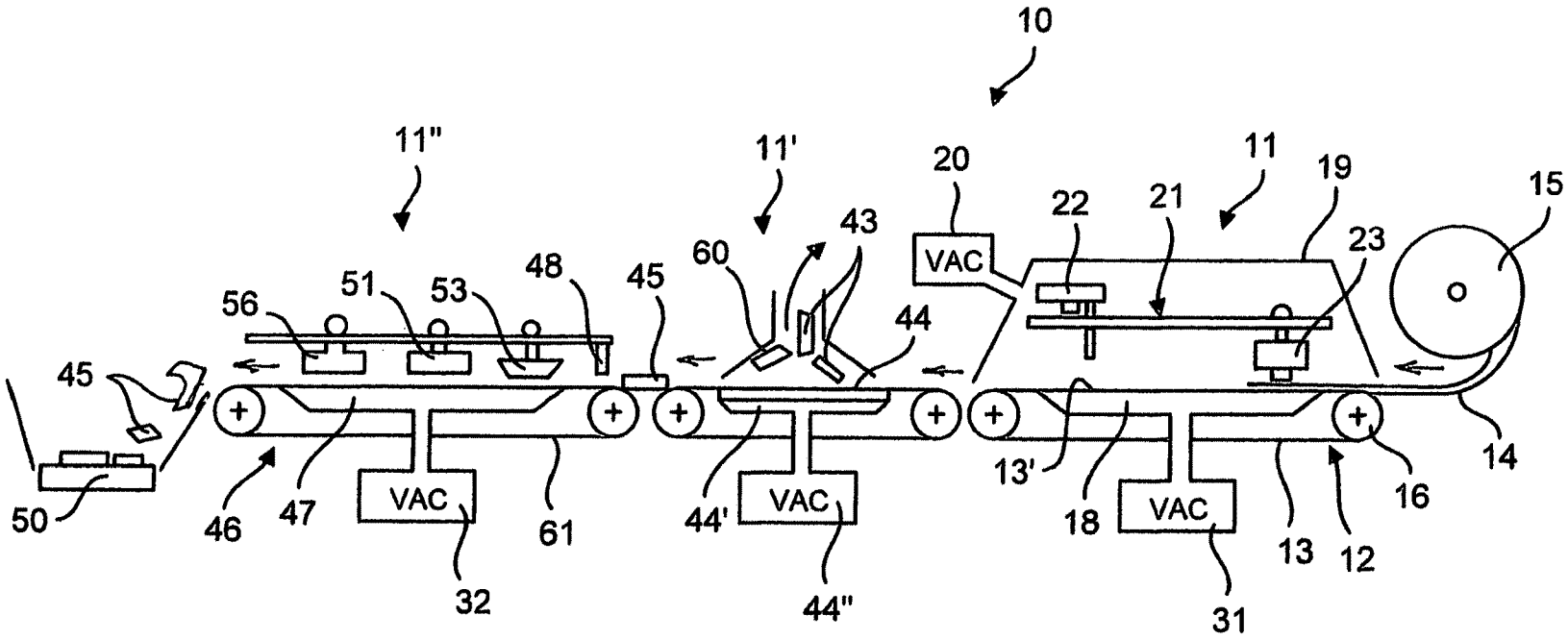
FIG. 1 is a schematic illustration of the automatic pattern fabric article piece processing machine of the present invention to fabricate pattern composite fabric pieces.
Figure 2:
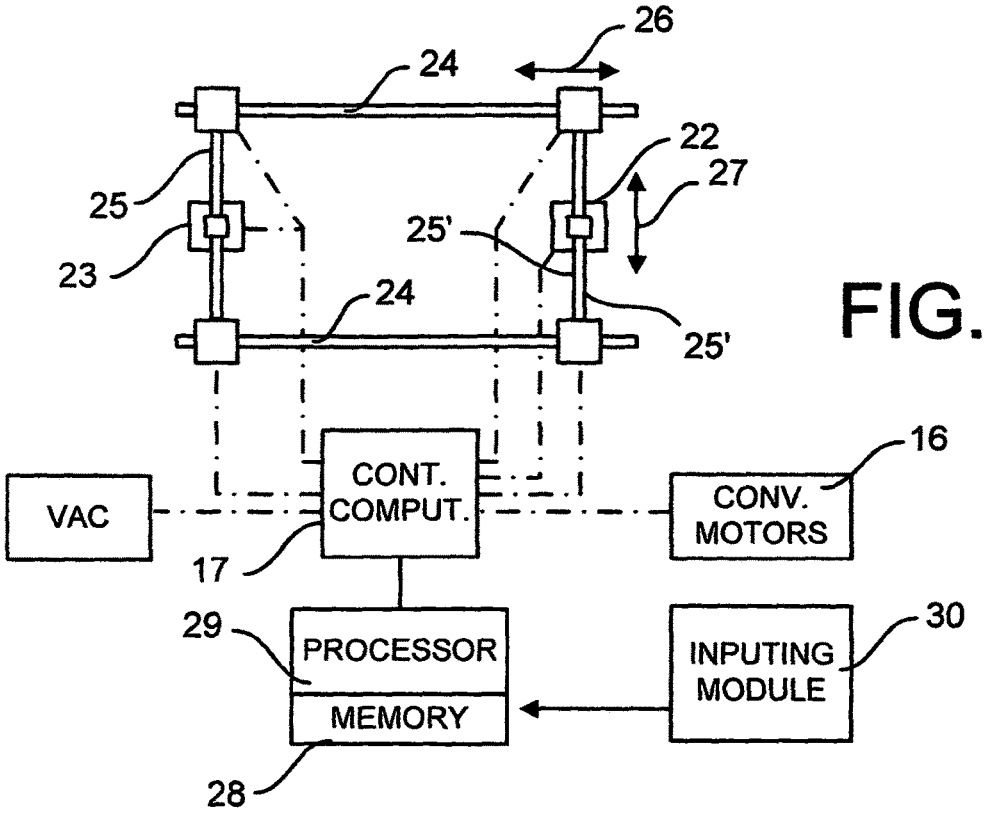
FIG. 2 is a further schematic illustration of the laser and stitching machine supports mounted in a dust free enclosure of a stage of the processing machine.

Referring now to the drawings and more particularly to FIGS. 1 and 2, there is shown, generally at 10 an example of the automatic pattern fabric article piece processing machine of the present invention and its method of operation. It is comprised of different stages and three stages are herein shown, namely a first stage 11 which is comprised of a conveyor 12 having a perforated or air permeable endless conveyor belt 13 on which is fed a composite fabric sheet 14 from a supply roll 15 for processing by the machine 10.

The endless belt 13 is operated by a motor which drives a drive drum 16 as obvious to a person skilled in the art and represented in FIG. 2 where it is shown controlled by a controller computer 17. A vacuum chamber 18 is disposed under the top run 13' of the endless belt 13 and connected to a vacuum pump 31 which is connected to a vacuum pump 31 which is operated to retain the bottom fabric sheet of the composite fabric sheet 14 stationary on the belt for job functions to be performed by the first stage 11 of the machine 10. As herein illustrated the first stage 11 has a top housing 19 to which is connected to a vacuum pump 20 to aspire dust or other material particle in the air within the housing 19 whereby the equipment in the housing can operate in a substantially dust proof environment.

Housed within the housing 19 is a support rail assembly 21 on which is displaceably supported one or more laser or thermal cutter head(s) 22 and an automatic stitching or ultrasonic bonding machine 23. Such mounting arrangement is schematically illustrated in FIG. 2. As shown, the rail assembly 21 is comprised of a pair of fixed rails 24 across which is displaceably mounted transverse rails 25 and 25'. The transverse rails are displaceable in the directions of arrow 26. The laser or thermal cutter head 22 is displaceably mounted on rail 25' and displaceable in the directions of arrow 27. These displacements are effected my motors not shown and controlled by the controller computer 17 to effect any shaped cuts in the composite material sheet in accordance with a pattern programmed in the memory 28 of the processor 29 of the computer by the inputting module 30. Likewise, the stitching machine 23 is controlled to effect pattern stitches in the composite material sheet 14. The laser or thermal cutter head(s) perform high precision cutting without arming the fabric sheets and the thermal cutting head does not produce fumes and therefore no special venting is required nor any pollution results from the cutting stage.

Figure 3:
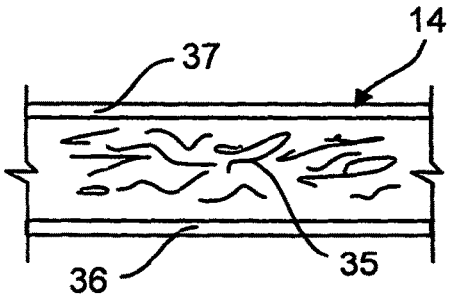
FIG. 3 is a fragmented side view of a composite fabric material sheet.
Figure 4:
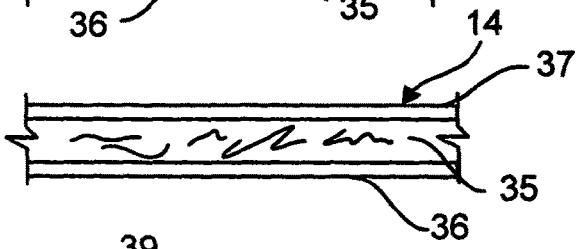
FIG. 4 is a fragmented side view of the composite fabric material sheet showing the sheet being compressed.

With additional reference now to FIGS. 3 to 8 there will be described the steps of operation performed by the first stage 11 of the processing machine 10. As shown in FIG. 3, the composite material sheet 14 is herein comprised of an insulating material, for example a synthetic, polyester, wool or down insulating material 35, held captive between a synthetic bottom fabric sheet 36 and a top fabric sheet 37. These fabric sheets may be constituted by two or more sheets to have a decorative outer sheet layer. The composite material sheet 14 is held captive and stationary under the housing 19 by the vacuum in the vacuum chamber 18 causing the material to also compress itself, as shown in FIG. 4 making it easier for the operations to be performed in a less dense material.

Figure 5:
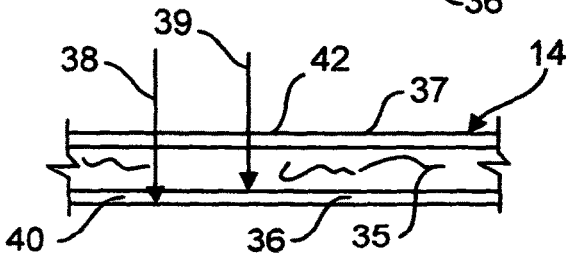
FIG. 5 is a further fragmented side view showing two laser cuts within the composite fabric material piece to form an allowance flap.
Figure 6:
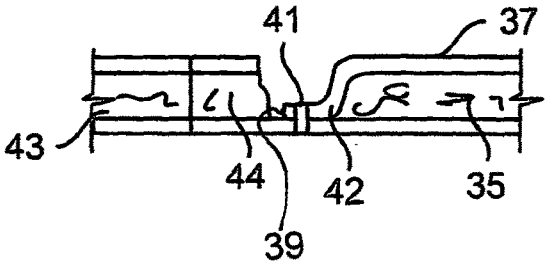
FIG. 6 is a still further fragmented side view showing a stitch seam formed in the composite fabric material piece adjacent one of the laser cut lines where the top fabric piece and insulation only has been cut.
Figure 7:
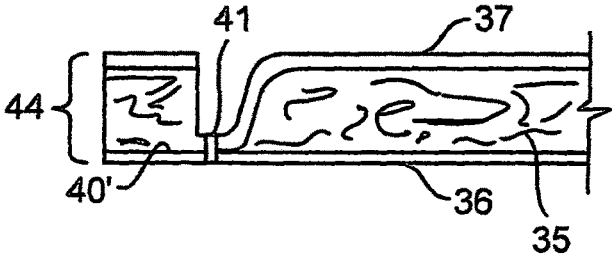
FIG. 7 is a further fragmented side view showing the outer trailing piece having been removed with a trailing piece still present on the seam allowance flap.
Figure 8:
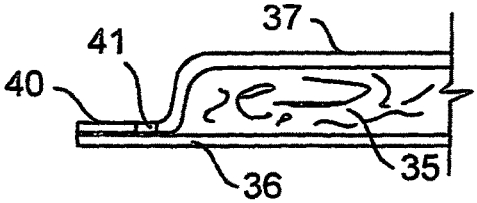
FIG. 8 is a further fragmented side view showing the trailing piece on the seam allowance flap removed and thus the formation of the clean seam flap to receive an identification mark thereon.
Figure 10:
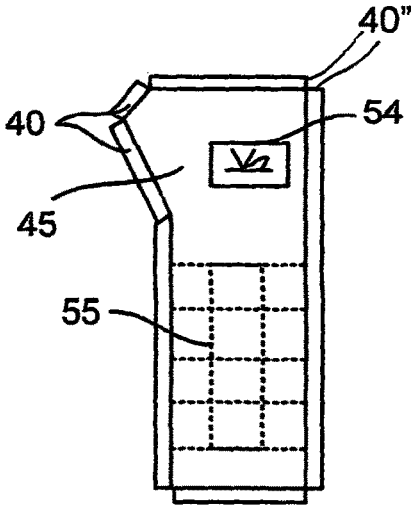
FIG. 10 is a plan view of a pattern fabric article piece wherein decorative stitch seams have been formed by the processing machine and a decorative label has been applied.

As shown in FIG. 5 the laser or thermal cutter head(s) 22 performs two pattern cuts in the composite fabric sheet 14, one cut 38 which cuts through the entire sheet 14 to define the outline of the pattern fabric piece to be manufactured and a second cut 39 which extends through the top fabric layer 37 and the insulating material 35 but not the bottom fabric sheet 36. Accordingly, a seam allowance flap 40 is being formed by the bottom fabric layer defined between the laser cuts 38 and 39. The end portions 40" of the seam allowance flaps, as shown in FIG. 10, are made by cuts formed in the inner fabric sheet. The controller 17 then actuates the automatic stitching machine 23 to be engaged and the laser cutter 22 to return to a storage position. The automatic stitching machine 23 then effects one or more stitch seam lines 41, as shown in FIG. 6, in the pattern piece being formed in a free edge portion 42 of the top sheet 37 adjacent the laser cut 39. As shown in FIGS. 6 and 7, trailing pieces 43 and 44 now have to be discarded and recycled where possible. When trailing piece 44 is removed the seam allowance flap 40 has a free outer face 40'. Trailing pieces consists of waste material of the fabric sheet remaining between the cut pattern pieces and over the seam allowance flaps.

Referring back to FIG. 1, once the pattern composite fabric pieces have been formed in the composite fabric sheet the laser or thermal cutter heads cuts the sheet there across. The conveyor 12 is then operated to transfer the composite fabric sheet with the cut fabric pieces 45 to the second stage 11' onto a perforated conveyor 46 of the processing machine 10 and input a further sheet length from the supply roll 15 into the first stage 11. In the second stage 11', the trailing pieces 43 and 44 are removed. This can be done manually, but in the present machine, this is accomplished by firstly positioning the composite fabric sheet 14 with the cut fabric pieces 45 and trailing pieces 43 on a patterned vacuum plate 44 under which only the pattern pieces are held by a suction force under the plate created by a vacuum chamber 44' there under and connected to vacuum pump 44". A suction chamber 60 is disposed above the composite fabric sheet 14 to create a suction only sufficient to suck out the trailing pieces 43, some of which have insulation thereon. This suction force is inferior to the retaining suction force applied under the cut fabric pieces 45. A detector 48 detects the transferred pattern fabric pieces 45 and feed the controller position and orientation information relating to the pattern cut fabric pieces 45. If desired, the cut fabric pieces can now be discharged in a collector or manually removed. However, the machine incorporates a third stage 11".

Figure 9:
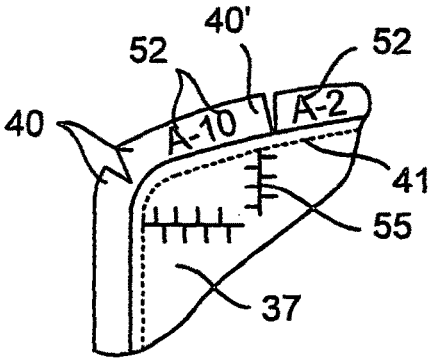
FIG. 9 is a fragmented view of a pattern fabric article piece showing identification printed matter on the seam allowance flaps.

The third stage 11" also has a controllable conveyor 61 to displace the composite fabric sheet with the cut fabric pieces. A vacuum chamber 47 connected to a vacuum pump 32 arrest and retain the fabric pieces at their specific position whereby further job functions can be effected thereto. As herein shown, the third stage 11" comprises a laser printer 51 to print identification means such as codes 52, as shown in FIG. 9 to identify the nature of the pattern fabric piece and a match connection code or number to another cut fabric piece for matching interconnection together, thus providing ease of matching pattern pieces for interconnection with one another. The printed information can also be substituted by other identification means. A decorative label or patch applicator 53 can also form part of the second stage to apply decorative labels automatically thereto to selected ones of the cut patter fabric pieces. Such a label 54 is illustrated in FIG. 10. As can also be seen in FIG. 10, a decorative quilt stitch pattern 55 was effected by the automatic stitching machine 23 in the first stage. A glue applicator device 56 may also form part of the third stage 11" to apply a glue substance on the seam allowance flaps 40 for interconnection. The displaceable devices in the third stage are also supported on a rail support assembly as in the first stage. After all job functions having been performed, the conveyor 61 ejects the fabric pieces 45 on a discharge conveyor 50.

Figure 11:
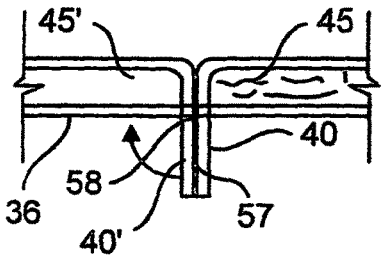
FIG. 11 is a fragmented side view showing two pattern fabric article pieces wherein the seam allowance flaps have been joined together by stitching or gluing.
Figure 12:
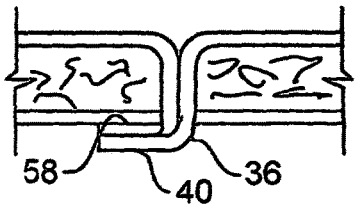
FIG. 12 is a view similar to FIG. 11 showing the interconnected seam allowance flaps being folded back and glued to the bottom fabric sheet of the composite material pieces.
Figure 13A:
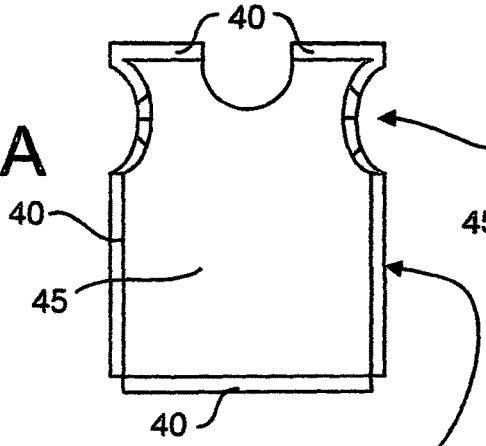
FIGS. 13A to 13C are plan views of a few pattern fabric article pieces formed in accordance with the present invention and ready for interconnection together to form a complete fabric article, herein a jacket article of apparel.
Figure 13B:
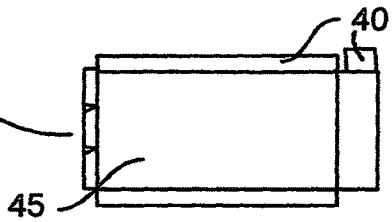
Figure 13C:
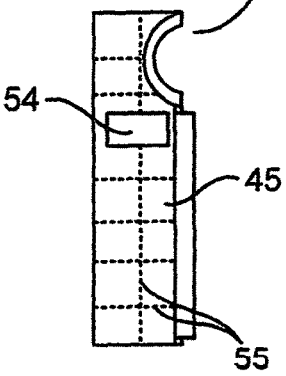

The pattern pieces 45 are interconnected together by the seam allowances by matching printed codes and sewing or heat fusing the seam allowance flaps to form a complete fabric article, such as an article of apparel, a bedspread which may be quilted, a cushion, etc. . . . These assembly of pattern pieces 45 are interconnected by their seam allowance flaps 40 and by such means as glue or stitching. The heat fusing process is, of course, much faster and less skill demanding than the stitching process. FIGS. 11 and 12 illustrates the interconnection of the seam allowance flaps 40 and 40' of two pattern fabric pieces 45 and 45', respectively. The flaps 40 and 40' have their glue faces brought together to bind with one another forming a glue seam 57. Glue 58 is then applied to an outer face of one of the flaps and the attached flaps are bent over the bottom fabric layer 36 of one of the pattern fabric pieces. Accordingly two of the pieces are interconnected together without the use of stitching machines which is time consuming. The glue may be a powder-like glue activated by heat. FIGS. 13A to 13C illustrate certain pattern fabric pieces 45 of an article of apparel and their interconnecting features of the seam allowance flaps.

Referring now to FIG. 14A, there is shown a composite fabric piece 60 formed of an outer fabric sheet 61 secured to an inner fabric sheet 62 by stitching or thermal fusing. The outer fabric sheet may have a design pattern embroidery 63 formed on the outer surface thereof or a stitch pattern (not shown) formed therein. The outer fabric sheet 61 may also consist of several fabric layers of different type fabrics and colors, herein illustrated a further fabric layer 64, which layer(s) are die cut by the laser or thermal cutting head(s) 22 of FIG. 1. These cutters are programmed to penetrate only the top layer or two or more fabric layers disposed on the inner layer (liner) and perform programmed cut outlines different from layer to layer to create design features. All sorts of design features may be formed in the outer fabric piece(s) 60. The seam allowance flap 65 is formed in a peripheral portion of the composite fabric piece 60 which is not fused, and this is accomplished by a laser or thermal cut 66 formed only through the outer fabric sheet 61, which may consist of several layers as above mentioned. The trailing piece 44 is removed in a manner as previously described.

In the embodiment illustrated in FIG. 14B, the seam allowance flap 66 is formed, in the first stage 11 of the machine, by a roll of fabric tape which is cut to size to form seam allowance flaps and heat fused in an outer surface overlapping portion 67 thereof of the inner fabric sheet 62, which is usually a lining fabric material. The projecting portion 68 forms the seam allowance flap 66.

With reference to FIG. 15 a brief summary of the method of fabricating pattern composite fabric pieces 45 in accordance with the present invention follows. A supply roll 15 of a composite fabric sheet 14 is disposed at the inlet of a conveyor 12 at a first stage 11 of the automatic processing machine 10. The sheet is moved by the conveyor to be positioned at a predetermined location and then held captive by a suction chamber under the air permeable conveyor belt 13'. The computer controller 17 then actuates the laser or thermal cutter head(s) 22 to effect cuts in the composite material sheet, as described herein above. The stitching device 23 then effects stitch seam lines or pattern designs as inputted in the memory of the computer. After the operations in the first stage terminated, the vacuum is cut off and the conveyor moves the composite fabric sheet with the cut pattern pieces 45 to the second stage 11' where the trailing pieces from the composite fabric sheet are removed and redirected for collection and conveyance to a remote area where the insulating material may be recycled or discarded.

In the third stage 11" various other operations can be performed as selected by the inputted information in the computer controller 17. Such other operations may include the application of decorative labels or other information labels, the printing of decorative motifs and identification and matching codes to the seam allowance flaps, and the application of glue on these flaps. Of course, the glue would be transparent not to conceal the printed information of the flaps. The pattern pieces 45 are maintained stationary in the third stage onto an air permeable conveyor belt by a vacuum chamber 47 positioned there under. The pattern pieces are then conveyed out of the third stage 11" and gathered and assembled for interconnection in a manner as above described to form a complete fabric piece. It is pointed out that some of the operations effected in the third stage may be effected in the first stage or previously in the composite fabric sheet 14 before being rolled to form the supply roll 15, illustrated in FIG. 1.

As can be appreciated from the above description of the preferred embodiment and its modifications, many phase in the fabrication of pattern composite fabric articles can be manufactured automatically in much smaller spaces within a clean and substantially dust particle free environment and with very little labour involvement and within a reduced time frame. Also, other devices may be incorporated in the stages described herein and other stages may be added to perform functions previously requiring labour content. By automating fabric pattern piece fabrication the labour content is greatly reduced and the quality in its fabrication is substantially improved and further resulting in less pollution and product waste. Such automated fabrication method now makes it commercially feasible to fabricate articles of apparel in countries without regard to higher labour costs.

It is within the ambit of the present invention to cover any obvious modifications of the preferred embodiments described herein, provided such modifications fall within the scope of the appended claims.

The invention claimed is:

1. A method of fabricating pattern composite fabric pieces, said method comprising the steps of:

i) feeding a composite fabric sheet having at least an outer and an inner fabric sheet in an automatic pattern fabric article piece processing machine, said processing machine performing, in one or more specific order, (ii) cutting one or more pattern pieces from said composite fabric sheet, and (iii) forming one or more seam allowance flaps in outer edge portions of said pattern pieces by forming a flap defining cut into said outer fabric sheet spaced inwardly from said outer edge portions and removing said outer edge cut portion of said outer fabric sheet whereby and outer edge portion of said inner fabric piece projects outwardly of said outer fabric sheet to define said seam allowance flaps, and wherein end portions of said seam allowance flaps are defined by cutting predetermined end defining cuts therein to delineate ends of said seam allowance flaps.

2. The method according to claim 1 wherein said step (ii) of cutting comprises laser or thermal cutting said pattern pieces.

3. The method according to claim 1 wherein said composite fabric sheet comprises a compressible intermediate material layer held captive between said inner and outer fabric sheet, and wherein said processing machine further comprises the steps of stitching or ultrasonic bonding one or more stitch seam lines in at least some of said one or more pattern pieces.

4. The method according to claim 3 wherein there is further provided the steps of (iv) separating said pattern pieces and trailing composite fabric sheet parts from said processing machine; and (v) gathering said cut pattern pieces.

5. The method according to claim 4 wherein there is further provided the step of (vi) assembling and interconnecting said seam allowance flaps of specific ones of said pattern pieces in a predetermined order to form a complete fabric article.

6. The method according to claim 5 wherein said processing machine is a multi-function stage machine and further comprises the step of applying an identification means to at least some of said seam allowance flaps to perform said method step (iv).

7. The method according to claim 5 wherein said step (vi) is comprised by interconnecting said seam allowance flaps of different fabric pieces by gluing said seam allowance flaps of said different fabric pieces together and further applying glue to an outer surface of said glued flaps and folding said glued outer surface against said bottom fabric layer of one of said pattern material pieces for securing said glued flaps thereto.

8. The method according to claim 5 wherein said step (v) is comprised by stitching said seam allowance flaps of different fabric pieces together.

9. The method according to claim 3 wherein said intermediate material is an insulating material, said insulating material being one of polyester insulation, wool insulation, acrylic insulation and down insulation material.

10. The method according to claim 3 wherein said step of stitching or ultrasonic bonding comprises stitching or ultrasonic bonding one or more seam lines a predetermined distance spaced from an outer edge of said seam allowance flaps of said cut pattern pieces all about said pattern pieces.

11. The method according to claim 10 wherein said seam lines are positioned spaced inwardly from an outer edge of said seam flaps, said seam allowance flaps being formed about at least sections of the entire outer periphery of said pattern fabric article pieces, and wherein some of said seam lines form decorative quilt patterns in said outer one of said opposed fabric sheets.

12. The method according to claim 1 wherein said processing machine further comprises the step of affixing to at least some of said pattern fabric article pieces a label to an outer surface of said outer one of said opposed fabric sheets.

13. The method according to claim 1 wherein said step (i) comprises one of (a) feeding said composite fabric sheet under a chamber defining an air space and wherein said air space is connected to vacuum machine to aspire air particle impurities from said air space, and (b) feeding said composite fabric sheet on a permeable conveyor belt, and wherein a vacuum chamber is provided under said permeable conveyor belt and a vacuum pump connected to said vacuum chamber to create a vacuum to arrest said composite fabric sheet thereon at a predetermined location.

14. A method of fabricating pattern composite fabric pieces, said method comprising the steps of:

i) feeding a composite fabric sheet having at least an outer and an inner fabric sheet in an automatic pattern fabric article piece processing machine, said processing machine performing, in one or more specific order, (ii) cutting one or more pattern pieces from said composite fabric sheet, and (iii) forming one or more seam allowance flaps in outer edge portions of said pattern pieces, and wherein said composite fabric sheet comprises a compressible intermediate material layer held captive between said inner and outer fabric sheet, and wherein said processing machine further comprises the steps of stitching or ultrasonic bonding one or more stitch seam lines in at least some of said one or more pattern pieces, said processing machine performs the steps of (a) compressing at least a portion of said composite sheet, said step (ii) of cutting comprising laser or thermal cutting said top one of said opposed fabric sheets and a bottom one of said opposed fabric sheets at a second predetermined location spaced from said first predetermined location to form a removable intermediate material piece over said seam allowance flaps constituting a trailing composite sheet part.

* * * * *